US006334261B1

(12) United States Patent
Scillia et al.

(10) Patent No.: US 6,334,261 B1
(45) Date of Patent: Jan. 1, 2002

(54) COLLAPSIBLE SQUARE

(75) Inventors: Robert Scillia, Berlin; Robert Owens, Southington, both of CT (US)

(73) Assignee: The Stanley Works, New Britain, CT (US)

( * ) Notice: Subject to any disclaimer, the term of this patent is extended or adjusted under 35 U.S.C. 154(b) by 0 days.

(21) Appl. No.: 09/421,524

(22) Filed: Oct. 20, 1999

(51) Int. Cl.[7] ..... B43L 7/10
(52) U.S. Cl. ..... 33/456; 33/463
(58) Field of Search ..... 33/418, 420, 452, 33/456, 458, 459, 463, 495–500, 453; 1/478

(56) References Cited

U.S. PATENT DOCUMENTS

| | | | | | |
|---|---|---|---|---|---|
| 738,224 | A | | 9/1903 | Morse | |
| 820,448 | A | | 5/1906 | Turpin | |
| 854,659 | A | | 5/1907 | Matthews | |
| 912,605 | A | | 2/1909 | Osmonson | |
| 986,239 | A | * | 3/1911 | Stoddard | 33/456 |
| 1,029,774 | A | * | 6/1912 | Taintor | 33/456 |
| 1,040,239 | A | | 10/1912 | Rarey | |
| 1,046,362 | A | | 12/1912 | Adams | |
| 1,142,418 | A | * | 6/1915 | Hamalainen | 33/418 |
| 1,344,269 | A | * | 6/1920 | Goodie | 33/418 |
| 1,394,088 | A | | 10/1921 | Heller | |
| 1,640,604 | A | | 8/1927 | Hauber | |
| 1,707,586 | A | | 4/1929 | Vieta | |
| 1,916,638 | A | | 7/1933 | Rizianu | |
| 2,031,661 | A | * | 2/1936 | Mendenhall | 33/420 |
| 2,193,793 | A | * | 3/1940 | Atherley | 33/459 |
| 2,205,621 | A | * | 6/1940 | Dulczewski | 33/458 |

(List continued on next page.)

FOREIGN PATENT DOCUMENTS

| | | | |
|---|---|---|---|
| DE | 3736512 C1 | 3/1989 | |
| DE | 4244622 A1 | 5/1993 | |
| FR | 401 980 | 9/1909 | |
| FR | 1 004 292 | 11/1951 | 33/456 |
| FR | 2 342 856 | 9/1977 | |
| GB | 13991 | of 1913 | |
| GB | 24202 | of 1913 | 33/458 |
| GB | 335919 | 3/1929 | |
| GB | 1 595 748 | 8/1981 | |
| GB | 2196438 A | 4/1988 | |
| GB | 2303461 A | 2/1997 | |
| WO | WO 98/47720 | 10/1998 | |

*Primary Examiner*—Christopher W. Fulton
(74) *Attorney, Agent, or Firm*—Pillsbury Winthrop LLP

(57) ABSTRACT

A collapsible square constructed according to the principles of the present invention includes a first elongated rigid leg having first and second ends and a second elongated rigid leg having first and second ends. The second elongated rigid leg is pivotally connected at its first end to the first end of the first elongated rigid leg. The collapsible square further includes a hypotenuse member comprising two elongated rigid leg portions. A first of the leg portions of the hypotenuse member and a second of the leg portions of the hypotenuse member have their first ends pivotally connected to the second end of the first elongated rigid leg and the second end of the second elongated rigid leg, respectively. The first of the leg portions and the second of the leg portions have second ends thereof connected to one another in a manner which permits the hypotenuse member to be folded. The first leg, the second leg, and the hypotenuse member are connected to one another so as to be movable between 1) a storage position wherein the first leg, the second leg, and the hypotenuse member are disposed in linear overlapping relation with one another, and 2) a deployed position wherein the first leg, the second leg, and the hypotenuse member form a right triangle. A releasable lock structure disposed at the second ends of the first and second leg portions is constructed and arranged to releasably lock the first leg, the second leg and the hypotenuse member in the deployed position.

17 Claims, 4 Drawing Sheets

U.S. PATENT DOCUMENTS

| | | | | | |
|---|---|---|---|---|---|
| 2,667,697 | A | | 2/1954 | McGrath | 33/105 |
| 3,345,750 | A | | 10/1967 | Hill | 33/75 |
| 3,490,148 | A | * | 1/1970 | Mathes | 33/458 |
| 4,872,267 | A | | 10/1989 | Anderton | 33/463 |
| 4,955,141 | A | | 9/1990 | Welch | 33/418 |
| 5,384,967 | A | | 1/1995 | Helmuth | 33/456 |
| 5,414,938 | A | * | 5/1995 | Meek | 33/452 |
| 5,771,767 | A | | 6/1998 | Itami | 83/435.13 |
| 5,971,677 | A | * | 11/1999 | Butwin | 33/463 |

* cited by examiner

COLLAPSIBLE SQUARE

FIELD OF THE INVENTION

The present invention relates to a collapsible square that can be folded into a storage position and unfolded to a deployed position capable of measuring predetermined angles.

BACKGROUND OF THE INVENTION

Squares are frequently used in the construction industry to layout and mark building materials. Squares are used, for example, during framing, tiling, cabinet installation and masonry work. Squares have two or more legs that form an angle such as a 90 degree angle. One leg is placed against a first structure, such as a foundation or floor, and the second leg is used to position or mark a second object, such as a sheetrock panel or a board used to construct a building frame, relative to the first structure. It is desirable that the legs of the square be long enough to span a substantial length along each structure to facilitate the positioning or marking. Therefore, the legs of the square are typically several feet long.

Because the legs of the square are long and are perpendicular in use, squares in their deployed positions are large and cumbersome to transport and store. Consequently, many squares are constructed so that the legs are movable relative to one another so that the square can fold or "collapse" into a storage position when not in use. Although the ability to move the legs of the square between deployed and folded positions facilitates transport and storage of the square, the manner of connection between the leg portions sometimes interferes with straight overlapping alignment of the leg members in the storage position or requires disconnection of one or more joints to move the legs into their storage position. Other squares provide for a movably adjustable connection between the leg members. However, the movable connection between the leg members may introduce the requirement of tedious angular adjustment to a desired angle and the possibility of slight angular misalignment when the square is moved into its deployed position.

Many squares include two elongated legs that form an angle and an elongated member or brace that holds the elongated legs in angle forming relation. U.S. Pat. No. 4,955,141, for example, shows an adjustable square that includes two legs that are pivotally mounted together and an elongated blade member that functions to releasably hold the two legs in a selected angular position. The elongated blade member is pivotally connected to one leg and slidably engaged within a longitudinally extending slot in the other leg. This type of device does not automatically move into a right angle position when fully deployed. In addition, they do not form a true right triangle, as the leg members extend beyond the intersection with the hypotenuse.

Many squares have three legs that are mounted together for movement between folded and deployed positions (and/or for angular adjustment) by sliding connections or by a combination of sliding and pivoting connections. U.S. Pat. No. 1,640,604, for example, shows a combination square having three legs, two of which are pivotally connected together and the third of which is slidably engaged with the first and second legs for angular adjustment. Patent reference WO 98/47,720 shows a square in the form of a 3-4-5 right triangle having two legs pivotally mounted to the largest leg (the hypotenuse) and slidably engaged with each other for movement between storage and deployed positions. One disadvantage of WO 98/47,720 is that the compactness of the square when in the storage position is limited by the length of the hypotenuse leg. Another disadvantage of many prior art squares is that they do not enable the square to be automatically and effectively locked in a right angle, deployed configuration.

In addition, sliding linkages between adjacent legs are generally disadvantageous because they are a possible source of inaccuracy when the square is set in a position of angular adjustment or when the square is moved to its deployed position. Thus, although sliding connections allow angular adjustment, these connections introduce the possibility of error and increase setup time. For squares that are movable between a folded position and a single deployed position, however, sliding connections are particularly undesirable because they introduce the possibility of error while providing no compensating advantage of allowing adjustability in the deployed position. Pivotal connections are more advantageous when a square assumes only two positions, a folded storage position and a deployed in position. Consequently, there is a need for square that is movable between storage and deployed positions using only pivotal connections between adjacent legs for movement between storage and deployed positions.

SUMMARY OF THE INVENTION

An objective of the present invention is to meet the need identified above. To meet this need, a collapsible square constructed according to the principles of the present invention includes a first elongated rigid leg having first and second ends and a second elongated rigid leg having first and second ends. The second elongated rigid leg is pivotally connected at its first end to the first end of the first elongated rigid leg. The collapsible square further includes a hypotenuse member comprising two elongated rigid leg portions. A first of the leg portions of the hypotenuse member and a second of the leg portions of the hypotenuse member have their first ends pivotally connected to the second end of the first elongated rigid leg and the second end of the second elongated rigid leg, respectively. The first of the leg portions and the second of the leg portions have second ends thereof connected to one another in a manner which permits the hypotenuse member to be folded. The first leg, the second leg, and the hypotenuse member are connected to one another so as to be movable between 1) a storage position wherein the first leg, the second leg, and the hypotenuse member are disposed in linear overlapping relation with one another, and 2) a deployed position wherein the first leg, the second leg, and the hypotenuse member form a right triangle. A releasable lock structure disposed at the second ends of the first and second leg portions is constructed and arranged to releasably lock the first leg, the second leg and the hypotenuse member in the deployed position.

Another object of the present invention is to provide a collapsible square that automatically sets the right angle once the square is moved into the right angle configuration, without the need for manual adjustment or manipulation. Accordingly, the present invention provides a collapsible square that comprises a first elongated rigid leg having first and second ends, a second elongated rigid leg having first and second ends, the second elongated rigid leg being connected at said first end thereof to said first end of said first elongated rigid leg, and a hypotenuse member connected to the second end of the first elongated rigid leg and the second end of the second elongated rigid leg, respectively. The rigid legs and the hypotenuse member are connected to one another in a manner that permits the square to be movable between 1) a storage position wherein the first leg, the second leg, and the hypotenuse member are disposed in linear overlapping relation with one another, and 2) a deployed position wherein the first leg, the second leg, and the hypotenuse member form a right triangle. A releasable lock structure at the second ends of the first and second leg portions automatically locks the elongated rigid legs and the hypotenuse member in the deployed position when the leg portions and the hypotenuse member are moved into the deployed position.

Other objects, features, and advantages of the present invention will become apparent from the following detailed description, the accompanying drawings, and the appended claims.

DETAILED DESCRIPTION OF THE PREFERRED EMBODIMENT AND BEST MODE OF THE INVENTION

Figure 1:
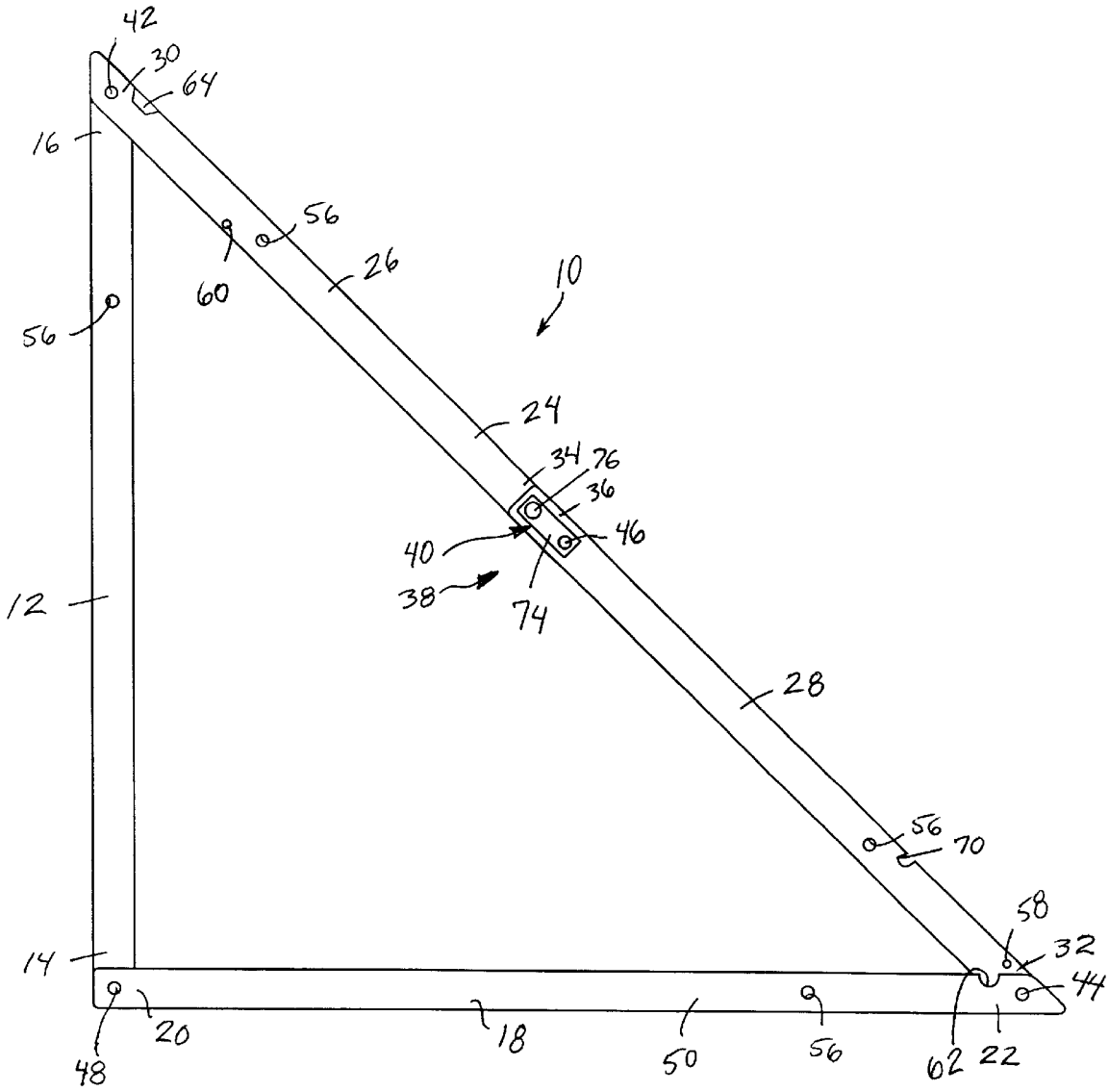
FIG. 1 is an side elevational view of a collapsible square constructed according to the principles of the present invention showing the square in a deployed position.

FIG. 1 shows a collapsible square, generally designated 10, constructed according to the principles of the present invention. The collapsible square 10 includes a first elongated rigid leg 12 having first and second ends 14, 16, respectively and a second elongated rigid leg 18 having first and second ends 20, 22, respectively. The second elongated rigid leg 18 is pivotally connected at the first end 20 thereof to the first end 14 of the first elongated rigid leg 12. A third leg 24 includes first and second elongated rigid leg portions 26, 28, respectively. The first of the leg portions 26 and the second of the leg portions 28 have respective first ends thereof, 30 and 32, pivotally connected to the second end 16 of the first elongated rigid leg 12 and the second end 22 of the second elongated rigid leg 18, respectively.

The first of the leg portions 26 and the second of the leg portions 28 have respective second ends thereof, 34 and 36, connected to one another at a connection 38 in a manner which permits limited relative movement between the second ends 34, 36 thereof so that the third leg 24 can be folded at the connection 38 between the first and second leg portions 26, 28 to enable the first leg 12, the second leg 18, and the third leg 24 to be moved between 1) a storage position (see, for example, FIG. 4) wherein the first leg 12, the second leg 18, and the third leg 24 are disposed in linear overlapping relation with one another, and 2) a deployed position (see FIG. 1) wherein the first leg 12, the second leg 18, and the third leg 24 form a right triangle. As can be appreciated from FIG. 1, when the collapsible square 10 is in its deployed position, the third leg 24 forms a hypotenuse member of the right triangle.

A releasable lock structure 40 at the second ends 34, 36 of the first and second leg portions 26, 28 is constructed and arranged so that when the third leg 24 is moved from the storage position to the deployed position, the releasable lock structure 40 terminates relative angular movement between the leg portions 26, 28 when the first and second leg portions 26, 28 are in a substantially aligned linear relation with one another.

The structural details of the collapsible square 10 can best be appreciated from an examination of FIGS. 1, 2, 5 and 6. Preferably the square 10 forms an isosceles right triangle in its deployed position. The first and second legs 12, 18 are preferably each approximately four feet long, 2 inches wide and 0.125 inch thick. The leg portions 26, 28 are each approximately two inches wide, 0.125 inch thick and are approximately 34.75 inches and 36.5 inches, respectively, in length. The total length of the third leg 24, accounting for the partial overlap of the portions 26, 28 when the square 10 is deployed is approximately 67.9 inches. Preferably the first and second legs 12, 18 and the first and second leg portions 26, 28 are made from 6063 aluminum and are pivotally connected by rivets 42, 44, 46, and 48. It can be understood from FIGS. 2 and 5 that rivets 42, 44 and 46 are identical to each other and that rivet 48 is an elongated spacer rivet.

Operation

When the collapsible square 10 is disposed in its storage position (FIGS. 2 and 4), the legs 12, 18, 24 are in generally abutting, overlapping linear relation (i.e., they are co-linear). In its storage position, the square 10 is approximately four feet long, two inches wide and ½ inch deep (where depth is measured between opposing exterior surfaces 50, 52 of the square as best understood from FIGS. 2 and 3) so that the folded square 10 can be easily carried or stored. The heads of the rivets 42, 44, 46, 48 are essentially flush with the respective adjacent surrounding surface of the associated legs 12, 18, 24. Each leg 12 and 18 and each leg portion 26, 28 is provided with an aperture 56. When the square 10 is in its storage position, the apertures 56 on the legs 12, 18 and on the leg portions 26, 28 are axially aligned so that the square 10 can hang on a nail or hook when not in use.

Figure 4:
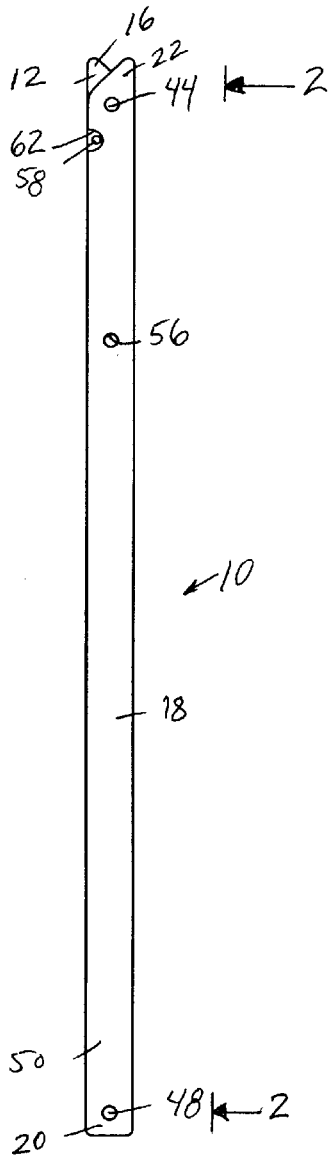
FIG. 4 is a side elevational view of the square in a folded position.
Figure 5:
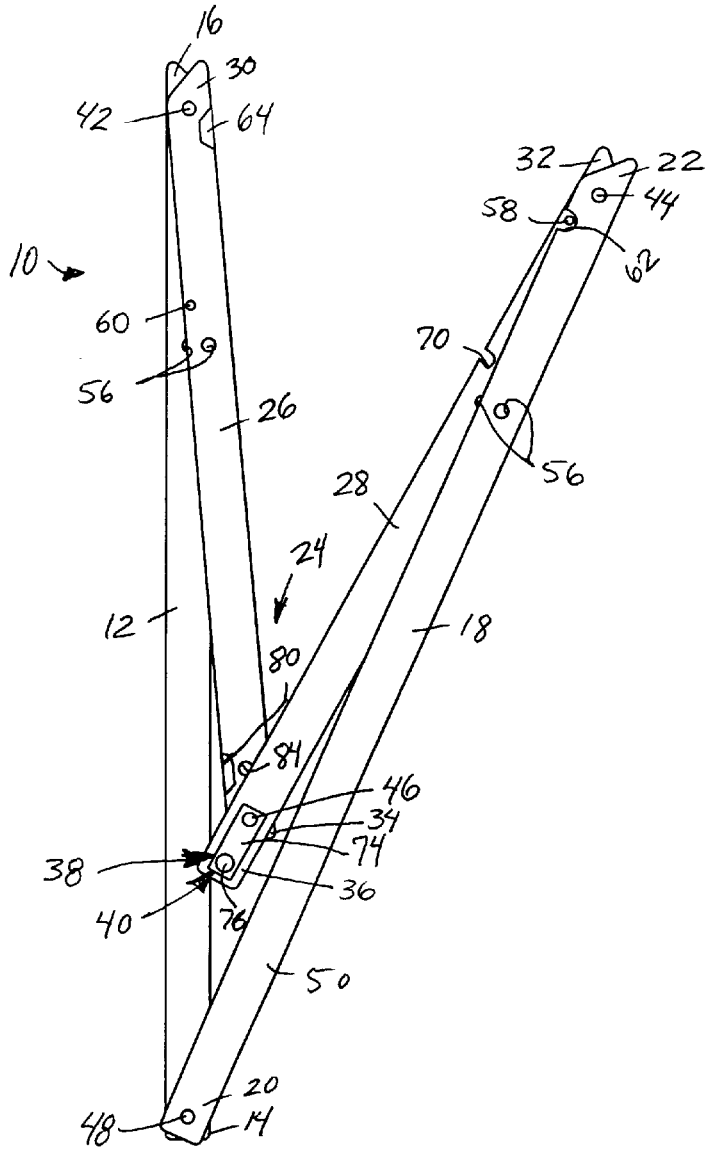
FIGS. 5 and 6 show the square in positions between the deployed and folded positions.
Figure 6:
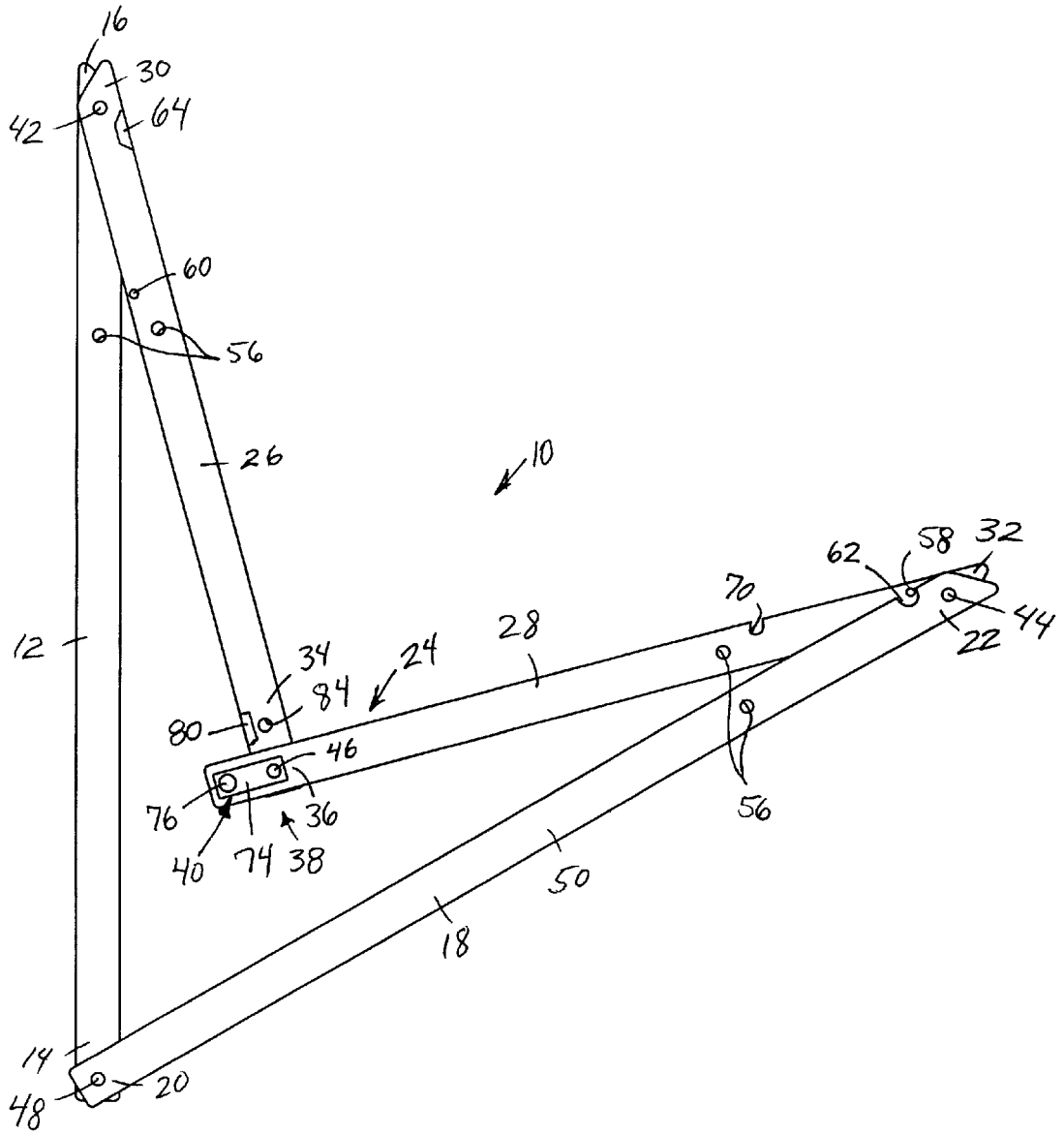

To deploy the square 10, the user pivots the first and second legs 12, 18 with respect to one another in an opening direction about the rivet 48. A comparison of FIGS. 4–6 illustrates this opening movement. This pivotal movement of the legs 12 and 18 in turn causes opening pivotal movement of the leg portions 26, 28 of the third leg 24 about the associated rivets 42, 44, 46. The square 10 includes movement limiting structure in the form of a first elongated pin member 58 rigidly mounted through the end 32 of the leg portion 28 of the third leg 24 and a second elongated pin member 60 rigidly mounted toward the end 30 of the first leg portion 26 of the third leg 24. The first elongated pin member 58 extends generally through the leg portion 28 and is received within a notch 62 in the second leg 18 and a recessed edge portion 64 of the first leg portion 26 when the square is in its storage position. The second elongated pin member 60 extends generally from one side of the first leg portion 26 and is received within a notch 70 formed in the second leg portion 28 of third leg 24 when the square 10 is in its folded position. The members 58, 60 limit the movement of the legs 12, 18 and 24 when the same are moving in a folding (i.e., closing) direction and also restrict the unfolding movement of the legs 12, 18, 24 to movement in one opening direction. It can therefore be understood that the movement limiting structure (provided by members 58, 60 and associated structures) allows the square to be unfolded from the storage position in only one direction.

Figure 2:
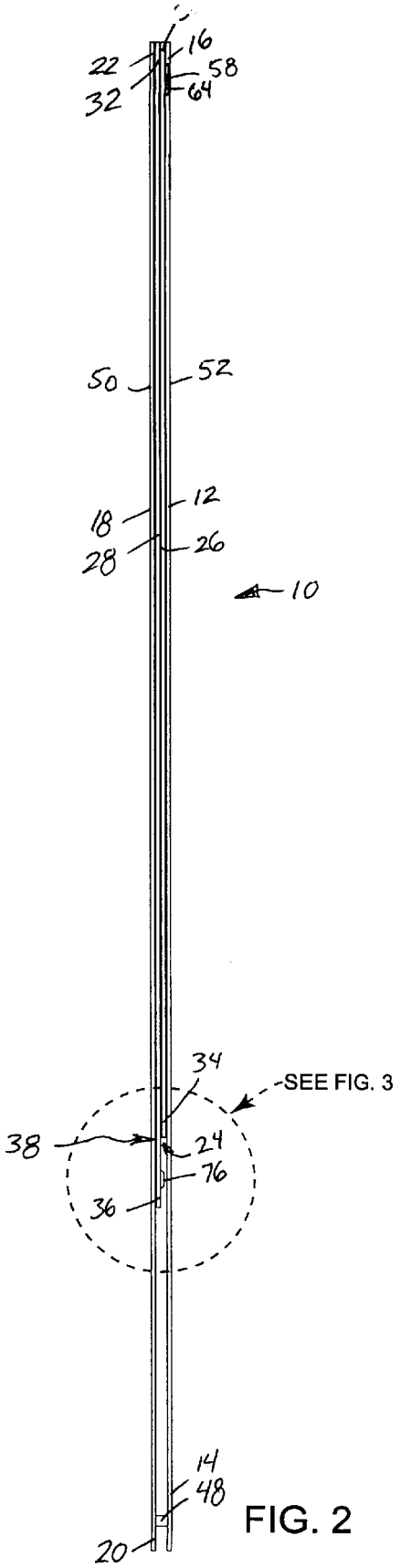
FIG. 2 is a front elevational view of the collapsible square taken along the line of sight 2—2 in FIG. 4.
Figure 3:
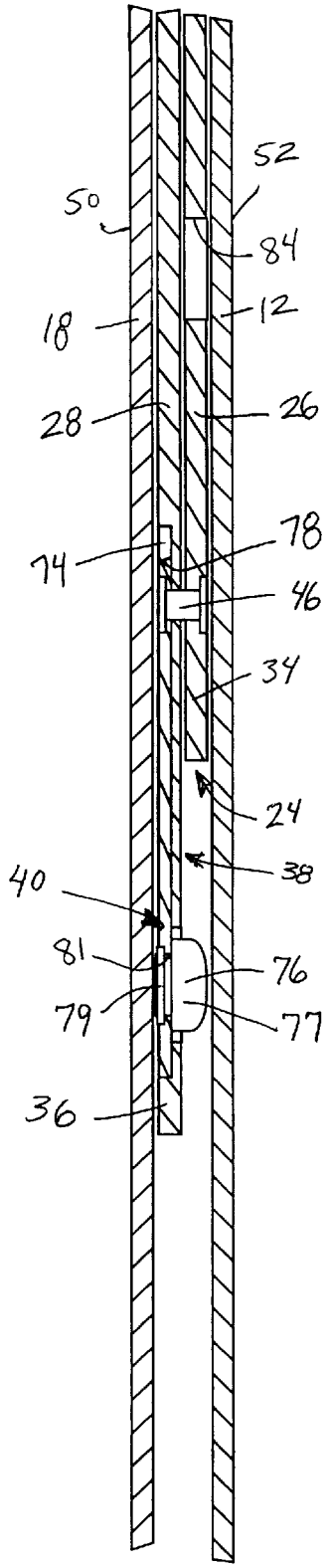
FIG. 3 is an enlarged sectional view of the square taken as indicated in FIG. 2.

It can be understood from FIG. 2 and from a comparison of FIGS. 4 and 5, for example, that when the square 10 is in its folded position, the third leg 24 is disposed between the first and second legs 12 and 18. Relative movement between the first and second legs 12, 18 in the unfolding direction commences the unfolding movement of the third leg 24. When the first and second legs 12, 18 are pivoted partially toward their deployed positions (as in FIG. 6, for example), the user can pull outwardly on the center portion of the third leg 24 to straighten the same. This will move the three legs 12, 18, 24 into their deployed position and lock in the square 10 in its right triangular configuration (FIG. 1). The releasable lock structure stops the movement of the legs 12, 18, 24 in their opening directions when the deployed position is reached and locks the legs 12, 18, 24 in the deployed position.

Specifically, the releasable lock structure 40 includes a releasable locking assembly 70 (see FIG. 3) that stops and releasably locks the leg portions 26, 28 of the third leg 24 in a generally linear extended configuration, thereby releasably locking the square 10 in its triangular configuration. The structure and operation of the locking assembly 70 can best be understood from FIGS. 1, 3, 5 and 6. The locking assembly 70 includes a spring blade 74 and a projecting member 76 that is rigidly mounted at one end of the spring blade 74. The projecting member 76 has a cylindrical body portion 77 and is preferably a metallic structure that is secured within an aperture 81 in the spring blade 74 by swedged end 79.

The spring blade 74 is generally disposed within a recess 78 formed within the leg portion 28 of the third leg 24 so that it is normally essentially flush with the side surface of the leg portion 28. The spring blade 74 is rigidly secured to the second leg portion 28 by the rivet 46. As the third leg 24 is moved into its deployed position (i.e., its linear extended position), the projecting member 76 slides over a beveled edge area 80 of the first leg portion 26 of the third leg 24 which causes the spring blade 74 to move resiliently outwardly of the recess 78. When the leg portions 26, 28 of the third leg 24 are linearly aligned, the projecting member 76 is axially aligned with a recess in the form of an aperture 84 provided in the first leg portion 26. The spring force of the spring blade biases the projecting member 76 in a leg locking direction into leg locking engagement with the aperture 84 to releasably lock the leg portions 26, 28 in linear relation and thereby releasably lock the square in its deployed configuration. Otherwise stated, the projecting members 76 automatically snaps into locking engagement in aperture 84 when the square is moved to the deployed position. The ends 16, 22 of the legs 12, 18, respectively, and the ends 30, 32 of the leg portions 26, 28, respectively, are mitered at forty five degree angles to form the triangular configuration in the deployed configuration.

Although preferred, the present invention contemplates that the releasable lock structure need not be of the type that automatically locks the square in the deployed position. Rather, a manually movable locking structure (e.g., such as tightening of a wing nut, moving a pivoted latch member or other locking mechanisms known in the art) can be used.

Because the square 10 forms an isosceles triangle in the deployed position, the square 10 can be used to measure 90 degree angles (using legs 12 and 18) and 45 degree angles (using leg 24 and either leg 12 or 18) during layout and construction. When the user has finished using the square 10, the square can be easily refolded to its storage position by manually pushing the projecting member 76 out of locked engagement with the aperture 84, pushing inwardly on the center of the third leg 24 to move the leg portions 26, 28 in a folding direction, and then moving in the first and second legs 12, 18 toward one another in a folding direction. It can be appreciated that the elongated pin members 58, 60 limit movement of the legs 12, 18, 24 in the folding direction as described above so that the legs 12, 18, 24 cannot be moved beyond their linear folded storage position when folding the square.

It can be understood that the square 10 shown in the figures and described herein is exemplary only and not intended to limit the scope of the invention. It is within the scope of the invention, for example, for the square to be an isosceles triangle having dimensions that are larger or smaller than those recited above. Similarly, although it is preferable for the square to form an isosceles triangle in the deployed position so that both 90 and 45 degree angles can be measured using the square in its deployed position, it is within the scope of the invention to provide a collapsible square that forms a right triangle in its deployed position but that is not an isosceles right triangle.

It should be appreciated that the automatic locking feature of the present invention is itself considered to be novel, and can be used irrespective of whether the legs and hypotenuse members are pivotally connected, slidably, or otherwise connected. For example, it is contemplated that the lock can be provided on an arrangement such as that disclosed by WO 98/47720, hereby incorporated by reference, so that when the sliding connection reaches a fully deployed right angle configuration, one of the corners is locked into a fixed angle. The lock is advantageous in that it sets the right angle once the square is moved into the right angle configuration, without the need for manual adjustment or manipulation.

It can thus be seen that the objectives of the present invention have been fully and effectively accomplished. It should be realized, however, that the foregoing preferred specific embodiment has been shown and described for the purpose of illustrating the structural and functional principles of the present invention and is subject to change without departure from such principles. Therefore, this invention includes all modifications, alterations, and substitutions encompassed within the spirit and scope of the appended claims.

What is claimed is:

1. A collapsible square, comprising:

a first elongated rigid leg having first and second ends;

a second elongated rigid leg having first and second ends, said second elongated rigid leg being pivotally connected at said first end thereof to said first end of said first elongated rigid leg;

a hypotenuse member comprising two elongated rigid leg portions, a first of said leg portions and a second of said leg portions having first ends thereof pivotally connected to said second end of said first elongated rigid leg and said second end of said second elongated rigid leg, respectively;

said first of said leg portions and said second of said leg portions having second ends thereof connected to one another in a manner which permits said hypotenuse member to be folded;

said first leg, said second leg, and said hypotenuse member connected to one another so as to be movable between 1) a storage position wherein said first leg, said second leg, and said hypotenuse member are disposed in linear overlapping relation with one another, and 2) a deployed position wherein said first leg, said second leg, and said hypotenuse member form a right triangle; and a releasable lock structure at said second ends of said first and second leg portions constructed and arranged to releasably lock said first leg, said second leg and said hypotenuse member in said deployed position, and wherein said releasable lock structure includes an aperture disposed in one of said two leg portions and a finger-activated projecting button resiliently attached to said other of said two leg portions, said button being movable relative to both of said two leg portions between a first position where said button is disposed within said aperture and a second position where said button is not disposed within said aperture, said aperture and button being constructed and arranged to enable said button to be passed through said aperture by a user's finger to disengage said button from said aperture.

2. A collapsible square according to claim 1, wherein said connection between said first and second leg portions is a pivotal connection.

3. A collapsible square according to claim 1, further comprising movement limiting structure that permits said first and second elongated rigid legs and said hypotenuse member to move relative to one another in predetermined unfolding directions when the square is moved from the storage position to the deployed position.

4. A collapsible square according to claim 1, wherein said releasable lock structure automatically locks said elongated rigid legs and said hypotenuse member in said deployed position when said leg portions and said hypotenuse member are moved into said deployed position.

5. A collapsible square according to claim 4, wherein said releasable lock structure lock said elongated rigid legs and said hypotenuse member in said deployed position by locking said leg portions of said hypotenuse member in a substantially linear condition.

6. A collapsible square, comprising:

a first elongated rigid leg having first and second ends;

a second elongated rigid leg having first and second ends, said second elongated rigid leg being pivotally connected at said first end thereof to said first end of said first elongated rigid leg;

hypotenuse member comprising two elongated rigid leg portions, a first of said leg portions and a second of said leg portions having first ends thereof pivotally connected to said second end of said first elongated rigid leg and said second end of said second elongated rigid leg, respectively;

said first of said leg portions and said second of said leg portions having second ends thereof connected to one another in a manner which permits said hypotenuse member to be folded;

said first leg, said second leg, and said hypotenuse member connected to one another so as to be movable between 1) a storage position wherein said first leg, said second leg, and said hypotenuse member are disposed in linear overlapping relation with one another, and 2) a deployed position wherein said first leg, said second leg, and said hypotenuse member form a right triangle;

a releasable lock structure at said second ends of sad first and second leg portions constructed and arranged to releasably lock said first leg, said second leg and said hypotenuse member in said deployed position; and movement limiting suructure that permits said first and second elongated rigid legs and said hypotenuse member to move relative to one another in predetermined unfolding directions when the square is moved from the storage position to the deployed position, and wherein said movement limiting structure terminates movement of said rigid legs and said hypotenuse member when said rigid legs and said hypotenuse member are in said aligned linear relation after being moved relative to one another in predetermined folding directions opposite said unfolding directions, said movement limiting structure including a first pin rigidly secured to said second leg portion and a first pin-receiving notch positioned on said second leg, and a second pin rigidly secured to one of said first and second leg portions and a second pin-receiving notch positioned on the other of said one of said first and second leg portions.

7. A collapsible square, comprising:

a first elongated rigid leg having first and second ends, an inside surface, and an outside surface;

a second elongated rigid leg having first and second ends, an inside surface, and an outside surface, said second elongated rigid leg being pivotally connected at said first end thereof to said first end of said first elongated rigid leg; and a hypotenuse member comprising two elongated rigid leg portions, a first of said leg portions and a second of said leg portions having first ends thereof pivotally connected to said second end of said first elongated rigid leg and said second end of said second elongated rigid leg, respectively, said first of said leg portions and said second of said leg portions having second ends thereof connected to one another in a manner which permits said hypotenuse member to be folded;

said first leg, said second leg, and said hypotenuse member connected to one another so as to be movable between 1) a storage position wherein said first leg, said second leg, and said hypotenuse member are disposed in linear overlapping relation with one another, and 2) a deployed position wherein said first leg, said second leg, and said hypotenuse member form a right triangle, and each of said first and second leg portions having an inside surface and an outside surface, said second end of said first leg and said first end of said first leg portion forming a generally pointed first corner, said first corner being formed by diverging first and second sides, said first side of said first corner being substantially collinear with said outer surface of said first leg and said second side of said first corner being substantially collinear with said outer surface of said first leg portion, and said second end of said second leg and said first end of said second leg portion forming a generally pointed second corner, said second corner being forked by diverging first and second sides, said first side of said second corner being substantially collinear with said outer surface of said second leg and said second side of said second comer being substantially collinear with said outer surface of said second leg portion.

8. A collapsible square according to claim 7, wherein wherein each of said second ends of said first and second legs are tapered.

9. A collapsible square according to claim 7, wherein wherein each of said first ends of said first and second leg portions are tapered.

10. A collapsible square according to claim 7, wherein wherein each of said second ends of said first and second legs are tapered and each of said second ends of said first and second legs are tapered.

11. A collapsible square according to claim 7, wherein wherein said hypotenuse member is disposed at a 45 degree angle relative to said first and second legs in said deployed position, each of said second ends of the first and second legs are tapered at a 45 degree angle, and each of said first ends of the first and second leg portions are tapered at a 45 degree angle, such that in said deployed position, each of said first and second corners form 45 degree angles.

12. A collapsible square according to claim 7, further comprising:

a releasable lock structure at said second ends of said first and second leg portions constructed and arranged to releasably lock said first leg, said second leg, and said hypotenuse member in said deployed position.

13. A collapsible square, comprising:

a first elongated rigid leg having first and second ends, an inside surface, and an outside surface;

a second elongated rigid leg having first and second ends, an inside surface, and an outside surface, said second elongated rigid leg being pivotally connected at said first end thereof to said first end of said first elongated rigid leg; and a hypotenuse member comprising, two elongated rigid leg portions, a first of said leg portions and a second of said leg portions having first ends thereof pivotally connected to said second end of said first elongated rigid leg and said second end of said second elongated rigid leg, respectively, said first of said leg portions and said second of said leg portions having second ends thereof connected to one another in a manner which permits said hypotenuse member to be folded, said first leg, said second leg, and said hypotenuse member connected to one another so as to be movable between 1) a storage position wherein said first legs said second leg, and said hypotenuse member are disposed in linear overlapping relation with one another, and 2) a deployed position wherein said first leg, said second leg, and said hypotenuse member form a right triangle, and each of said first and second leg portions having an inside surface and an outside surface, said outer surfaces of each of said first and second legs and said first and second leg portions forming an outermost perimeter with three sides substantially in the shape of a triangle and forming three intersecting lines lying in three intersecting planes, respectively, and wherein the entire extent of said collapsible square is positioned within said three intersecting planes.

14. A collapsible square, comprising:

a first elongated rigid leg having first and second ends;

a second elongated rigid leg having first and second ends, said second elongated rigid leg being pivotally connected at sad first end thereof to said first end of said first elongated rigid leg;

a hypotenuse member comprising two elongated rigid leg portions, a first of said leg portions and a second of said leg portions having first ends thereof pivotally connected to said second end of said first elongated rigid leg and said second end of said second elongated rigid leg, respectively;

said first of said leg portions and said second of said leg portions having second ends thereof connected to one another in a manner which permits said hypotenuse member to be folded;

said first leg, said second leg, and said hypotenuse member connected to one another so as to be movable between 1) a storage position wherein said first leg, said second leg, and said hypotenuse member are disposed in linear overlapping relation with one another, and 2) a deployed position wherein said first leg, said second leg, and said hypotenuse member form a right triangle; and a releasable lock structure at said second ends of said first and second leg portions constructed and arranged to releasably lock said first leg, said second leg and said hypotenuse member in said deployed position, the releasable lock structure being movable from the deployed position, where the releasable lock structure is locked, to an unlocked position, where said first leg, said second leg, and said hypotenuse member are movable to a storage position, wherein said releasable lock structure includes a cantilevered spring blade positioned within said first leg portion, said spring blade biasing said lock structure into said locked position and permitting a projecting member on said spring blade to move between the deployed and unlocked position when activated by a user.

15. A collapsible square according to claim 14, wherein said releasable lock structure includes a recess disposed in said second leg portion, said projecting member being movable relative to both of said two leg portions between a first position where said projecting member is disposed within said recess and a second position where said projecting ember is not disposed within sad recess, and wherein said spring is constructed and arranged within said releasable lock structure to bias said projecting member into said recess.

16. A collapsible square according to claim 14, wherein said spring blade couples said projecting member to said other of said leg portions.

17. A collapsible square, comprising:

a first elongated rigid leg having first and second ends and a first hole;

a second elongated rigid leg having first and second ends and a second hole, said second elongated rigid leg being pivotally connected at said first end thereof to said first end of said first elongated rigid leg; and a hypotenuse member comprising two elongated rigid leg portions, a first of said leg portions and a second of said leg portions having first ends thereof pivotally connected to said second end of said first elongated rigid leg and said second end of said second elongated rigid leg, respectively, said first of said leg portions and said second of said leg portions having second ends thereof connected to one another in a manner which permits said hypotenuse member to be folded, said first leg, said second leg, and said hypotenuse member connected to one another so as to be movable between 1) a storage position wherein said first leg, said second leg, and said hypotenuse member are disposed in linear overlapping relation with one another, and 2) a deployed position wherein said first leg, said second leg, and said hypotenuse member form a right triangle, and said first leg portion having a third hole and said second leg portion having a fourth hole, and said first, second, third, and fourth holes being aligned in said storage position to form a fastening opening.

* * * * *